United States Patent [19]

McCaghren et al.

[11] Patent Number: 4,597,356

[45] Date of Patent: Jul. 1, 1986

[54] BOAT MOTOR CONTROL PLATFORM FOR USE WITH FISHERMAN'S CHAIR

[76] Inventors: Charles P. McCaghren, 1802 5th Ave., SW., Decatur, Ala. 35601; Jack A. Mullican, Rte. 3, Chapel Hill Rd., SW., Decatur, Ala. 35603

[21] Appl. No.: 699,410

[22] Filed: Feb. 7, 1985

[51] Int. Cl.[4] ..... B63B 17/00

[52] U.S. Cl. ..... 114/363; 114/153; 440/7

[58] Field of Search ..... 114/153, 194, 363; 440/7; 74/478

[56] References Cited

U.S. PATENT DOCUMENTS

| | | | |
|---|---|---|---|
| 3,151,910 | 10/1964 | Larson | 114/363 |
| 3,602,181 | 8/1971 | Harris | 440/7 |
| 3,642,320 | 2/1972 | Ward | 114/363 |
| 4,008,500 | 2/1977 | Hall | 114/363 |
| 4,063,321 | 12/1977 | Nichols | 114/363 |
| 4,143,436 | 3/1979 | Jones | 114/363 |
| 4,425,863 | 1/1984 | Cutler | 114/363 |
| 4,515,567 | 5/1985 | Wilson | 114/153 |

*Primary Examiner*—Trygve M. Blix
*Assistant Examiner*—Stephen P. Avila
*Attorney, Agent, or Firm*—George J. Porter

[57] ABSTRACT

A motor control support for a fishing boat employed in conjunction with a fisherman's chair (10) which is mounted on a first end of a vertically positioned pedestal (12) and with the second end of the pedestal being secured rotatably in a receiving pedestal support (24) securely mounted on the deck. The motor control support includes a sleeve (14) which fits around the pedestal (12) and which is connected to a first end of an elongated arm (28) in such a manner that the arm (28) is pivotal in a vertical direction. The other end of the arm (28) is secured to a receiving structure (30) formed on the underside of a platform (34) which supports the motor control assembly (35). The arm (28) can be secured in any desired position so it can have any desired effective length from the chair pedestal (12) to the motor control supporting platform (34). The platform (34) has casters (36 and 38), secured on the underside surface thereof, which ride upon the deck (22) in an arcuate path. Because the arm (28) is connected in a manner to be vertically pivotal with respect to the sleeve (14) the platform (34) can ride up and down along its arcuate path upon an uneven deck surface (22).

2 Claims, 5 Drawing Figures

BOAT MOTOR CONTROL PLATFORM FOR USE WITH FISHERMAN'S CHAIR

TECHNICAL FIELD

This invention relates generally to a platform used in combination with a fisherman's chair on a fishing boat and which holds the motor controls, usually for an electric motor. More particularly the invention relates to a simpler and less expensive platform arrangement for holding such motor controls as employed in combination with a fisherman's chair.

BACKGROUND OF THE INVENTION

There are several prior art structures which include a movable platform for holding the motor controls of a fishing boat in combination with a fisherman's chair which in turn is usually attached to the boat deck in a rotatable manner on a vertical pedestal. These prior art structures are generally relatively heavy and bulky and often mechanically and electrically complex and consequently costly. They further present problems in transportation thereof, not only in the changing of the position of the arrangement from one location on the fishing boat deck to another, but also in the transportation thereof by vehicle if the owner of the fisherman's chair and platform moves the chair and platform from a fishing boat to his home or to another fishing boat. For example, U.S. Pat. No. 4,008,500 to Hall shows a fisherman's chair rotatable on a different axis than the axis on which the platform is rotatable, and an electric motor and gear arrangement within the assembly housing to independently operate the chair and the platform. U.S. Pat. No. 3,151,910 to Larson shows a fishing chair and platform requiring a plurality of struts to support the structure upon the deck as well as an arcuate track mounted upon the deck to guide the rotation of the chair and the platform and also to provide additional support for the overall structure. The main supporting post for the chair pedestal is particularly complex, requiring a large number of parts including several concentric tubular parts. U.S. Pat. No. 4,063,321 to Nichols is a somewhat simpler structure but still requires five separate struts to support the platform which itself has no direct support upon the deck. U.S. Pat. No. 4,143,436 to Jones is another combination fisherman's chair and motor control holding platform that is particularly complex electrically in that it requires a helical slip ring type electrical contact for carrying electricity from a battery to the helical slip ring and ultimately to the motor. This helical slip ring is arranged concentrically around the pedestal supporting the chair and appears to be permanently affixed to the fishing boat deck with several wires running underneath the deck, all of which make the overall structure nontransportable from one location to another.

It is a primary object of the present invention to provide a platform for supporting the boat motor controls (usually packaged as a unit) which is simple in construction, lightweight, and easily transportable from one location to another.

It is a further object of the invention to provide an improved platform, for carrying the motor controls of the fishing boat, which is attached to the chair pedestal by a main sleeve which fits around the pedestal and an arm attached thereto, and which is supported on casters or the like to enable movement of the platform in an arcuate path on the deck of the fishing boat.

Another object of the invention is to provide means to enable vertical pivoting of the arm joining the platform with respect to the sleeve around the chair pedestal, thereby enabling the platform to move vertically up and down to accommodate unevenness on the boat deck as the platform moves in its arcuate path on the boat deck.

A further object is to provide means for adjusting the effective length of the arm between the platform and the sleeve surrounding the chair pedestal.

Still another object of the invention is to provide sleeve inserts which fit inside the main sleeve to adapt the resultant sleeve arrangement to chair pedestals of different diameters.

Yet another object of the invention is to provide indentations in the platform marking the locations where holes can be drilled to receive bolts for securing to the platform motor controls made by different manufacturers.

SUMMARY OF THE INVENTION

In accordance with a preferred form of the invention, there is provided in a fishing boat having a fisherman's chair mounted upon the boat deck by means of a vertically positioned pedestal with a circular cross section and having a first diameter and rotatively mounted in a pedestal holder securely mounted on the boat deck, an assembly for holding the controls which control the electric motor propelling the boat and which comprises a tubular shaped sleeve which fits snugly and rotatively around the pedestal supporting the chair, and a locking arrangement such as a set screw for selectively causing the sleeve to be either rotatable or non-rotatable about the pedestal. Also provided is an elongated arm attached at its first end to the sleeve in such a manner as to be vertically pivotal and, at its second end, to a generally horizontally positioned platform having an upper surface for supporting the motor controls and an underside surface. Arm securing means are provided on the underside surface of the platform for securing to the platform the second end of the elongated arm at different points along the elongated arm so as to alter the effective length of the arm. Casters or rollers are secured on the underside surface of the platform for enabling the platform to roll on the deck in an arcuate path around the chair pedestal within predetermined limits. The arm and the arm securing means can be rectangular in cross-sectional shape or have some other suitable mating cross-sectional shape.

Features of the invention include pivotally mounting the arm to the tubular sleeve to enable the platform to move up and down vertically and thereby roll easily over an uneven deck surface, and sleeve inserts which fit inside the main sleeve to adapt the resultant sleeve arrangement to chair pedestals of different diameters.

DETAILED DESCRIPTION OF THE INVENTION

Figure 1:
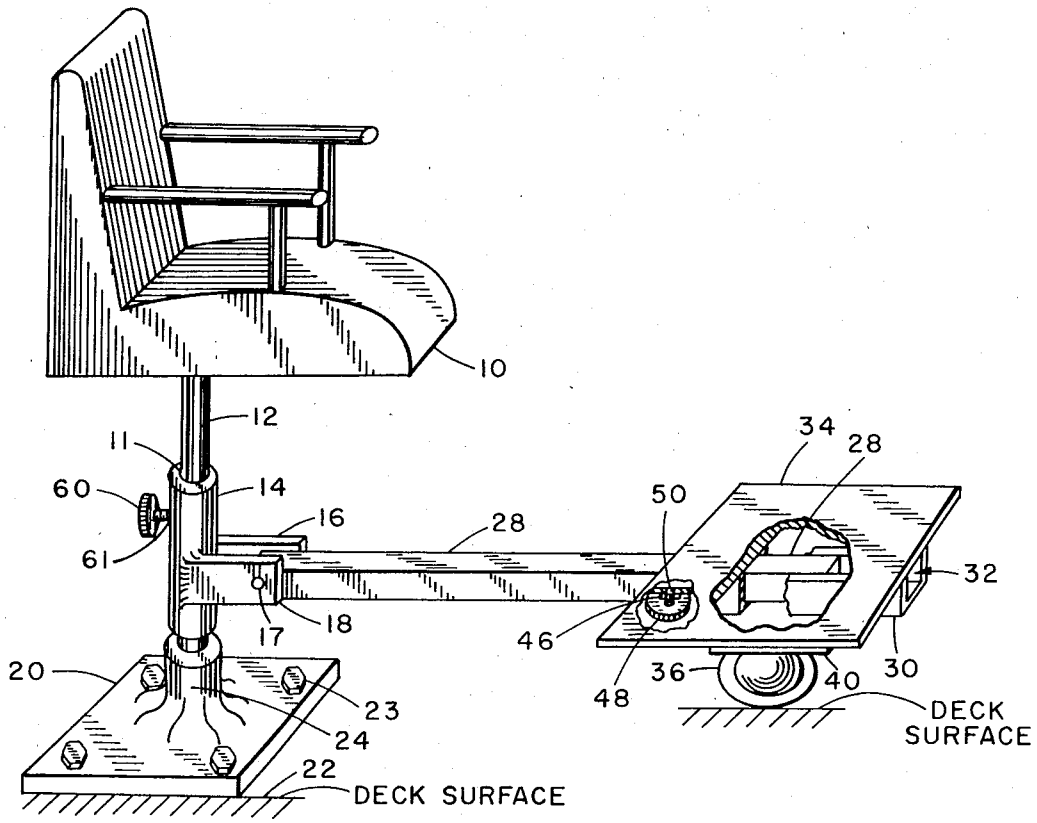
FIG. 1 is an isometric view of the fisherman's chair, the sleeve, the vertically pivotal arm, the platform, and the casters which support the platform on the deck.

Referring now to FIG. 1, a fisherman's chair 10 is mounted vertically on a pedestal 12 which passes through a tubular shaped sleeve 14 and then to a supporting structure which includes a plate 20 mounted on the deck surface 22 by bolts 23 and a pedestal receiving element 24, all of which together support the pedestal securely on the boat deck 22 in a vertical position so that pedestal 12 is rotatable in pedestal receiving element 24.

Figure 2:
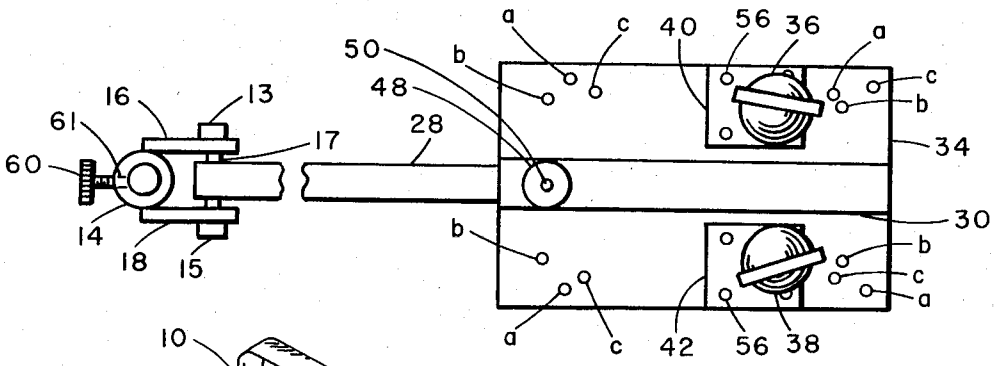
FIG. 2 is a view of the under side of the platform, the elongated arm, and the sleeve and shows more clearly how the arm is connected to the sleeve so as to be vertically pivotal.

The sleeve 14 can have secured thereto a pair of ear-like elements 16 and 18 between which a first end of arm 28 is positioned. The ear elements 16 and 18 and the first end of arm 28 each have a hole formed therethrough which, when registered together, receive a pin 17 which holds arm 28 within the earlike elements 16 and 18 in a manner to allow the arm 28 to pivot vertically. It should be noted that pin 17 is shown without an end head which would prevent pin 17 from slipping out of the holes in which it fits. Such end heads are shown in FIG. 2 as heads 13 and 15 which can be, respectively, the head 15 and securing nut 13 of a threaded bolt.

Figure 5:
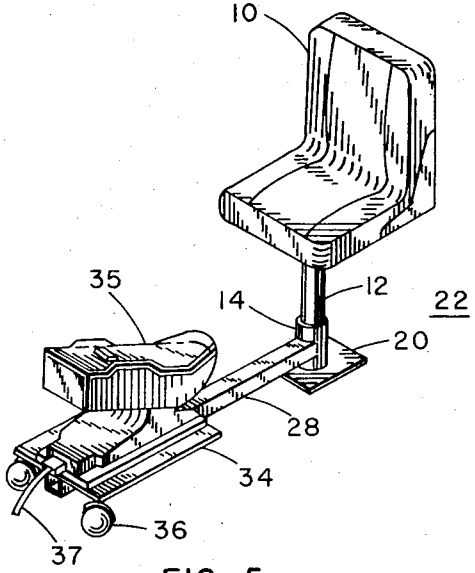
FIG. 5 is an alternative embodiment of the fisherman's chair with the boat motor control platform attached and with the boat motor control assembly mounted on the platform.

The other end of arm 28 is received within the rectangular opening 32 of a rectangular channel 30 formed on the underside surface of platform 34 which supports the motor control assembly 35 (see FIG. 5 ). Set screw 60 can be tightened through threaded hole 61 in sleeve 14 to cause sleeve 14 and therefore arm 28 and platform 34 to rotate together with chair 10. Alternatively, set screw 60 can be loosened slightly to allow chair 10 to rotate independently of sleeve 14 and therefore independently of arm 28 and platform 34.

Casters or rollers 36 and 38 (See FIGS. 2 and 4) are secured to the underside surface of plate 34 by means of smaller plates 40 and 42 (See FIGS. 2 and 4) which can be welded or bolted to the supporting main platform 34. The casters 36 and 38 ride upon the deck surface 22. Although casters and 38 are shown in all figures of the drawings as being ordinary carpet casters, they may also be dual-wheeled carpet casters of a type which is commercially available. Dual-wheeled casters are particularly advantageous when deck surface 22 is uneven or contains uneven joints in deck planking.

A set screw arrangement includes a finger operated circular element 48 and a threaded portion 50, which passes through a threaded boss 46, secured to the underside of channel 30, and then through the underside of channel 30 to abut against the underside of arm 28 and thereby hold arm 28 in whatever position it was placed before the set screw assembly was tightened. Broken away portion 62 of the top of platform 34 shows arm 28 passing through opening 32 of channel 30.

Referring now to FIG. 2 the relation of the ear-like elements 16 and 18 to sleeve 14 and arm 28 can be seen more clearly. The pin 17 which, as mentioned above, can be the threaded portion of a bolt having a head 15 and a nut 13 is also shown more clearly passing through the two ear-like elements 16 and 18 and one end of arm 28.

The arrangement of casters 36 and 38 and their supporting plates 40 and 42 with respect to main platform 34 and the receiving channel 30 can also be seen better in FIG. 2. The plates 40 and 42 can be secured to the platform 34 by means of bolts or rivets 56. Finger turning element 48 of the set screw arrangement is also shown in FIG. 2, as well as in FIGS. 3 and 4.

Figure 3:
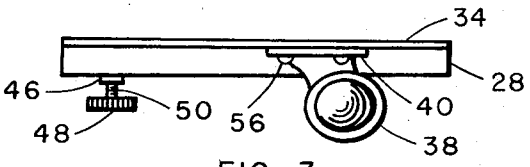
FIG. 3 is a side view of the platform showing the main platform, the casters, a channel formed on the under side of the main platform to receive the elongated arm, and a set screw arrangement to hold the arm within the receiving channel formed under the platform.
Figure 4:
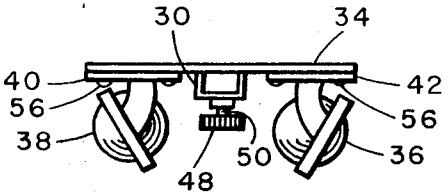
FIG. 4 is an end view of the platform again showing the main platform, the casters, the channel that receives the arm, which can be rectangular in shape, and a set screw arrangement for tightening the arm within the receiving channel formed under the platform.

FIGS. 3 and 4 respectively show the motor control supporting platform 34 along with the supporting casters 36 and 38.

FIG. 5 is an isometric view of an alternative embodiment of the fisherman's chair 10, mounted on pedestal 12, which extends down through sleeve 14 and is supported by plate 20 mounted on deck surface 22. Platform 34 is supported by casters 36 and 38 and is slideably attached to arm 38, which is firmly attached to sleeve 14. Motor control assembly 35 is mounted on platform 34 and is connected to the motor (not shown) by cable 37.

All of the parts of the assembly of FIG. 1 can be of aluminum except the casters which can be conventional off-the-shelf heavy duty furniture type casters. Typical dimensions of various elements of the structure can be as follows. The main platform 34 can be 11' long, 7½" wide, and ¼" thick. The walls of the channel 30 formed on the underside of platform 34 can be ⅛" thick with the channel itself having an outside width dimension of 1½" and a depth of ¾". Arm 28 can be 21" long with cross-sectional dimensions of 1" by ½". Sleeve 14 can have an outside diameter of 3" and a wall thickness of ¼". The plates 40 and 42 can each be about ¼" thick although they are a part of the casters and will necessarily have dimensions determined by the caster manufacturer. The casters 36 and 38 make contact with the boat deck about 3½" from the end of platform 34 and about 1½" in from the sides of platform 34. The three groups of four indentations a, b, and c represent spots where holes are to be drilled to accommodate motor control units manufactured by three different manufacturers, "a", "b", and "c". The combined weight of the sleeve, the arm, and the complete platform is about five pounds.

From the foregoing, it may be seen that the present invention provides a boat motor control platform device which pivots with ease, thus preventing fatigue by allowing a fisherman to fish in any direction while keeping his foot control under his foot. In addition, this structure provided by the present invention stabilizes the foot control during transit, which prevents the destruction of expensive fishing equipment when running in rough water. Adjustments to the device may be made and then locked easily by tightening the set screws 60 and 48. This device is easily installed and easily removed from most small fishing boats.

It is to be understood that the form of the invention shown in the figures and described in the specification is but a preferred embodiment thereof and that various other arrangements will be apparent to one skilled in the art to which the invention pertains, for example, other ways for vertically connecting arm 28 to sleeve 14 and other cross sectional shapes and dimensions of arm 28, channel 30, and sleeve 14, without departing from the spirit or scope of the invention.

We claim:

1. The combination of a fisherman's chair and a platform for holding a boat motor control for use on the deck of a fishing boat and comprising;

a fisherman's chair having a supporting first sized pedestal of circular cross section extending downwardly from said chair;

a receiving means mounted securely on said deck for receiving and rotatably supporting said pedestal in a vertical position;

a first tubular shaped sleeve rotatably mountable around said pedestal and having a pair of parallel ear-like elements extending outwardly from and beyond the perimeter of said first sleeve;

an elongated first channel-like element secured at a first end to said ear-like elements in a manner to be vertically pivotal;

a horizontal platform having a substantially flat upper surface for mounting said motor control, an underside surface, and a second channel-like element secured on said underside surface with a cross sectional opening of a shape to slidably receive said first channel-like element;

means for securing said first channel-like element within said second channel-like element at desired locations; and a pair of casters mounted on the underside surface of said platform to enable said platform to move in an arcuate path around said pedestal with the radius of said arcuate path being determined by the positioning of said first channel-like element within said second channel-like element.

2. The combination of claim 1 in which said platform has a plurality of groups of indentations formed therein with each group of indentations marking those spots where holes are to be drilled to receive screws for mounting a given type of motor control on said platform.

* * * * *